United States Patent [19]

McDaniel et al.

[11] 3,948,381

[45] Apr. 6, 1976

[54] PRINTER WITH NON RETURN TO HOME RACK SHIFT SELECTION MECHANISM

[75] Inventors: Robert F. McDaniel, Paris; John O. Schaefer, Lexington, both of Ky.

[73] Assignee: International Business Machines Corporation, Armonk, N.Y.

[22] Filed: Dec. 23, 1974

[21] Appl. No.: 535,406

[52] U.S. Cl. ..... 197/18; 197/55; 197/82

[51] Int. Cl.[2] ..... B41J 23/04

[58] Field of Search ..... 197/16, 17, 18, 48, 49, 197/50, 55, 60, 82, 84, 89, 90, 96

[56] References Cited

UNITED STATES PATENTS

| | | | |
|---|---|---|---|
| 3,352,398 | 11/1967 | Crutcher et al. | 197/16 |
| 3,559,791 | 2/1971 | Waldenburger | 197/55 |
| 3,572,486 | 3/1971 | Hebel et al. | 197/55 X |
| 3,596,745 | 8/1971 | Waldenburger | 197/55 |
| 3,666,070 | 5/1972 | Schaefer | 197/18 |
| 3,738,471 | 6/1973 | Werff et al. | 197/16 X |
| 3,876,053 | 4/1975 | Giolitti et al. | 197/18 |

*Primary Examiner*—Edgar S. Burr
*Assistant Examiner*—R. T. Rader
*Attorney, Agent, or Firm*—Laurence R. Letson

[57] ABSTRACT

Disclosed is a mechanism for shifting the rack of a selection mechanism for a single element printer from one portion to another in timed relationship to the translation of a barrel cam which provides the necessary mechanical input to control the amount of rotation of the typehead. The control of the rack shift mechanism is a cam arrangement operated in timed relationship with the translating barrel cam to provide for the shifting of the rack at the beginning of each print cycle, if necessary, and the retaining of the rack in its shifted position at the completion of the cycle, thereby eliminating the necessity to provide for the time required to shift the rack back to its home position at the end of the cycle. The elimination of the restore operation of the rack provides more time during the cycle to operate the selection mechanism and accomplish printing or conversely provides for a smaller amount of time being required for the necessary functions thereby providing the capability of operating the remainder of the mechanism at a faster rate.

5 Claims, 7 Drawing Figures

PRINTER WITH NON RETURN TO HOME RACK SHIFT SELECTION MECHANISM

RELATED CO-PENDING APPLICATIONS

"Non Return to Home Rack Shift Selection Mechanism For Single Element Printer" Ser. No. 535,391 co-filed herewith, Dec. 23, 1974, in the name of W. A. Abell, et al.

BACKGROUND OF THE INVENTION

As the selection mechanism for single element typewriters is incorporated into the print carrier for machine simplification and reliability, one approach has been to utilize a single translating rack element to provide, selectively, two directions of rotation to the typehead through a rack and pinion arrangement. One illustrative embodiment of this type of mechanism is to be found in Ser. No. 375,277 filed June 29, 1973 in the name of Iraj D. Shakib, titled Single Print Element Print Carrier with Self Contained Selection Function. The disclosure of this co-pending application, Ser. No. 375,277, is hereby incorporated herein by reference, for an explanation of the mode of operation and structure as disclosed therein.

In the Shakib application, the rack is pivotly mounted and is rocked about its axis of rotation to provide for the engagement and disengagement of the rack teeth with the pinion. This is accomplished by means of, alternatively, electromagnetic or pneumatic elements.

In view of the actions of pneumatic elements only being to act in one direction, it was necessary that the rack be restored to its home position at the completion of each operation.

The restoration of the rack to its home position at the end of each cycle required a nominal amount of time in each cycle which if eliminated could provide for greater flexibility.

The device disclosed in the Shakib specification, referenced above, required that time be allocated for a restoration of the rack mechanism at the end of each cycle. This allocation of time during any one print cycle restricted the ability to lengthen other operational times during the print cycle and therefore reduced design flexibility. Further, in requiring the time necessary to restore the Shakib mechanism, it, to some extent, restricted and hampered efforts to improve the speed of the mechanism.

OBJECTS OF THE INVENTION

It is an object of the invention to shift a bifurcated rack and thus control the direction of rotation of a pinion, only at the beginning of a cycle prior to any movement of a translatory mechanism for selecting a character on a single element typehead. It is another object of the invention to orient and engage a selected portion of a bifurcated rack with a pinion, regardless of which portion the rack was engaged, in response to the rotation of a cam member.

It is still another object of this invention to prevent the inadvertent shifting of the rack in mid cycle.

SUMMARY OF THE INVENTION

The disclosed device utilizes a rotating cam arrangement having a double lobe such that when a two legged or bifurcated follower is positioned so that one and only one of the lobes is engaged by one of the follower arms, the rack may be shifted in response to an external signal during the initial portion of the print cycle. As the cam which controls selection begins to rotate, the two lobed shift cam also rotates and the follower is positioned so that one lobe will engage one leg and if the rack is in the wrong position, in response to the input signal controlling the follower the follower and lobe engage and the follower rises providing the required mechanical input into the rack select mechanism to cause the rack to shift so that the other of the two racks becomes engaged with the pinion, thus conditioning the pinion for appropriate direction of rotation as the translating barrel cam begins its translation.

In the event that the last character required the same direction of rotation as the upcoming character the follower will be in a position such that it will not be engaged by the rise of the cam lobe and thus no action will occur.

The foregoing and other objects, features and advantages of the invention will be apparent from the following more particular description of preferred embodiments of the invention, as illustrated in the accompanying drawings.

DRAWINGS

FIGS. *3a – 3d* illustrates the safety feature preventing shifting at times other than designated times.

Figure 1:
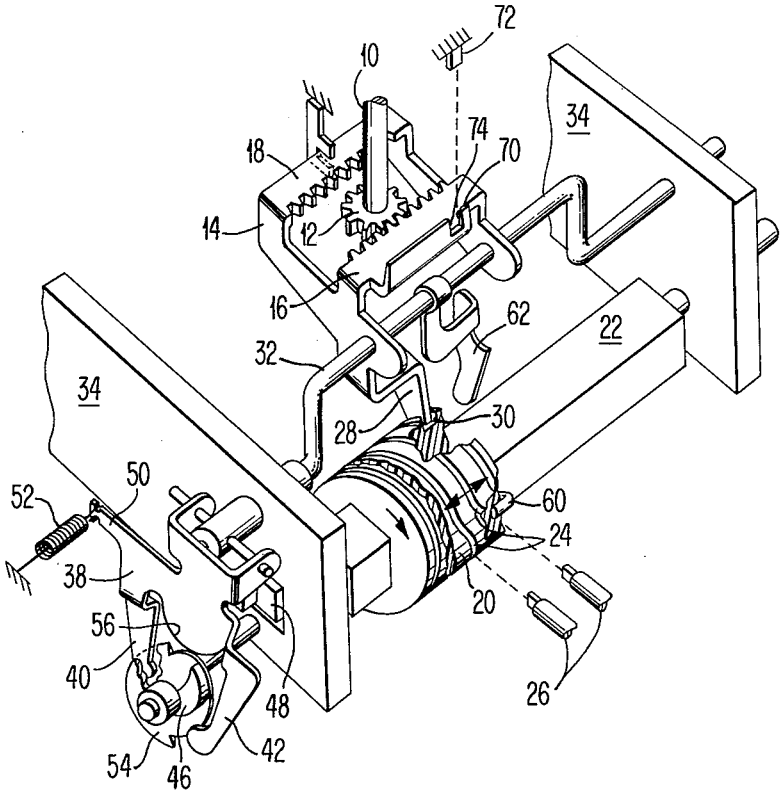
FIG. 1 is an illustration of a filtered, cam controlled non return to home rack shift mechanism.
Figure 4:
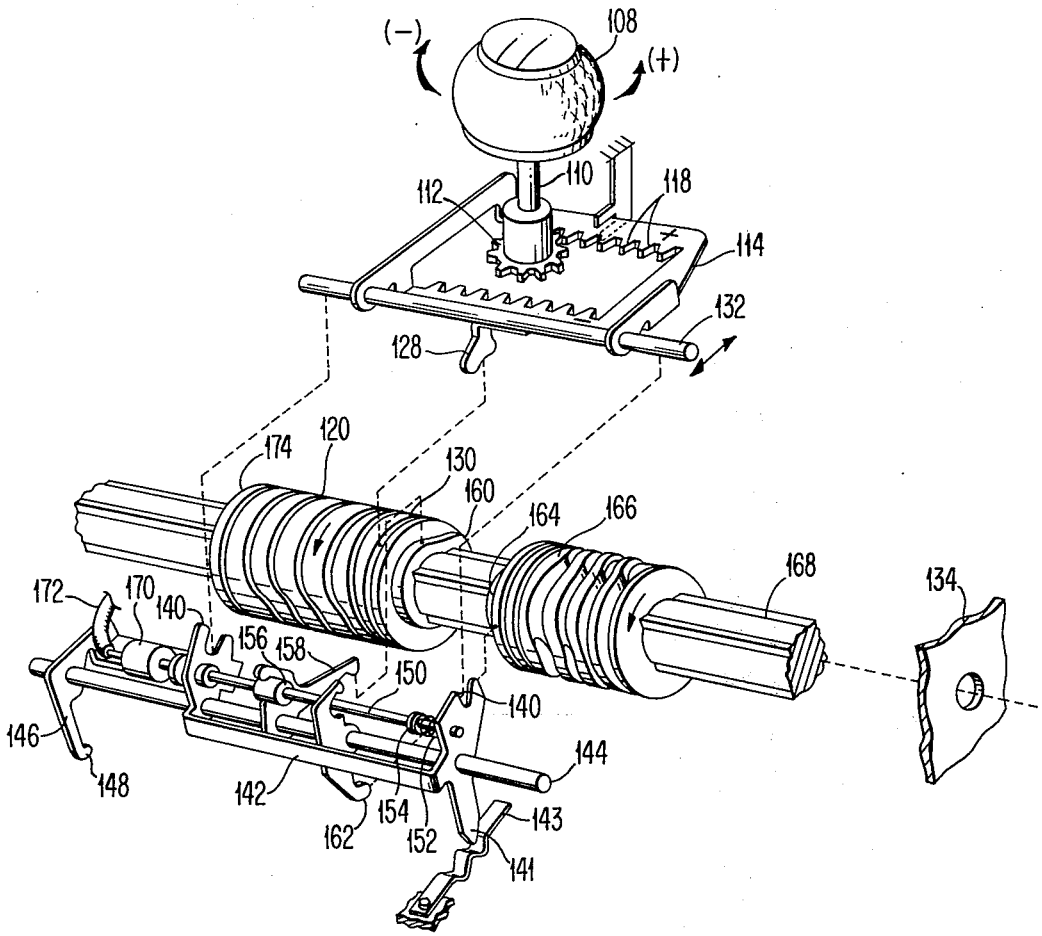

FIG 4 is an illustration of another embodiment of the concept illustrated in FIG. 1.

Detailed Description

The invention will be described with respect to several embodiments.

Referring to FIG. 1, print element rotation shaft 10 is supported on a rocker assembly of the type shown in the Shakib specification, referenced above. Inasmuch as the rocker and the rocking of the rocker is not part of this invention, it is not shown herein.

Attached to the type element rotation shaft 10 at its lower extremity is rotate pinion 12. Rotate pinion 12 is provided, together with rack member 14 to create rotary motion of shaft 10 by the tranlatory motion of rack 14. Rack 14 is provided with two separate toothed sides or portions 16 and 18. Support for rack 14 is found on the rocker, not shown. The support restrains the movement of rack 14 in a plane such that parts of rack 16 and 18 are always moving in the plane of the pinion. Rack 14 has the two portions 16 and 18 positioned such that as one rack disengages from the pinion on shifting, the other rack has begun its engagement. This eliminates the possibility of the pinion being free to rotate without being under the control of one rack or the other and thus prevents unintentionally getting the pinion out of phase with the selection cam.

To provide the input forces necessary to translate rack 14 a measured distance, a barrel cam 20 is mounted on driving shaft 22 in such a manner that it rotates with shaft 22 and is also capable of translation along shaft 22 in an axial direction. Barrel cam 20 is provided with a plurality of cam grooves 24 which may be individually and selectively engaged by cam follower selector pins 26. The rotation of cam 20 passed selector pins 26 when one of the selector pins is engaged in one of the cam grooves 24, causes the axial translation of cam 20 along the axis of shaft 22. The translation of cam 20 must then be transmitted to rack 14. To translate the movement of cam 20 to rack 14, rack 14 is provided with a follower 28 which engages a follower groove 30 on cam 20. A more complete discussion of this type system is contained in the Shakib application Ser. No. 375,277, above.

Rack 16 in order to accomplish its shifting, must have some input. To provide the necessary input to the rack for rack selecting, the shift bail 32 is pivotally mounted on side frame members 34 of the carrier. The rotation of shift bail 32 in its pivotable supports in side frames 34 provides for an oscillation of the offset crank portion of bail 32, thus providing a short front-rear motion to rack 14. The bail 32, pivot supports, and input connections comprise the rack select mechanism.

The forces required to shift rack 14 in its front-rear direction are derived from a cam follower arrangement. Follower 38 is pivotally attached to shift bail 32 on an axis which is perpendicular to the axis of rotation of shift bail 32. Follower 38 is also provided with a bifurcated formation such that there are two depending legs or follower portions 40, 42 depending from the main portion 38. Follower leg 40 may be engaged with cam 44. Cam 44 may be more easily observed in FIG. 2. When cam follower 40 is engaged with the follower with lobe 44, the depending leg 42 of follower 38 is pivoted frontwardly in FIG. 1 such that it clears cam lobe 46 and therefore has no effect. When the follower 38 is retracted towards frame member 34, follower leg 42 will then engage lobe 46 and at the same time follower 40 will disengage from lobe 44.

To provide the necessary movement of the follower 38 for the selecting of the direction in which the rack select mechanism will be shifted as a result of which cam lobe will be engaged, a plurality of different devices may be selected from. As an example, FIG. 1 illustrates a magnetic coil 48 which may be energized and thus attract follower 38 to it, much as an armature is attracted in an magnetic relay. To provide a restoring force, a spring member may be attached to spring arm 50 and is illustrated as spring 52. Other possibilities would be the substitution of a pneumatic device in lieu of the electromagnet 48 where the pneumatic device would push follower 38 outwardly from frame 34 and then a spring biasing arm 50 in the opposite direction could be used for restoration.

Figure 2:
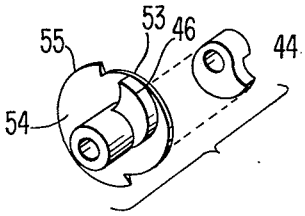
FIG. 2 is a view of a two lobe cam for control of the rack select and shifting mechanism.

Referring to FIG. 2, cams 44 and 46 are separated by filter ring 54. Filter ring 54 has a circumference which is positioned at two distinct radial distances from the axis of rotation.

Now referring back to FIG. 1, it can be seen that follower 38 has a semi-circular or curilinear portion 56 positioned immediately above filter ring 54. The depending portion 56 is positioned spacially such that the lower extremity thereof does not reach down as far as circumference portion 53 but does extend downward past the arc of circumference portion 55. Circumference portion 55 of filter ring 54 is sharpened to a relatively sharp edge. As filter ring 54 rotates with cams 44 and 46, the switching of follower 38 can only be accomplished during that portion when filter ring circumferential portion 53 is in the vicinity of portion 56 of follower 38. Thus it can been seen that filter ring 54 and particularly that portion of the larger radial distance 55 acts as an interlock to prevent the shifting of follower 38 during the portions of a cycle which would be detrimental if the rack was shifted or if followers 42 and 40 attempted to simultaneously engage both cam lobes 44 and 46. Also circumference portion 55 will insure complete engagement of the followers with one cam lobe and prevent malfunction.

Cams 44 and 46 together with filter ring 54 are mounted rigidly on an extension of drive shaft 22 so that they rotate in timed relation to the selection and translation of cam grooves on cam 20 and thus in timed relation to the translation of the rack 14.

To accomplish compound or additive rotation of printhead shaft 10, for case shift, cam 20 is provided with a lug 60. To engage lug 60 and utilize motion generated by it, a follower 62 is attached to the offset crank arm of shift bail 32. Lug 60 engages the surface of follower 62, follower 62 is caused to rotate in a clockwise direction as viewed in FIG. 1. The turning of follower 62 which is rigidly attached to the crank arm of shift bail 32 causes shift bail 32 to rotate about its pivot points thus causing the shift of rack 14 to engage the set of rack teeth 18.

As can be appreciated, cam 20, to which lug 60 is fixedly imbedded, translates in the direction parallel and co-axial with drive shaft 22 and the only time that lug 60 may encounter follower 62 is at its maximum displacement or six units of selection. This is analogous to the camming surface which is found on the cams as described in the Shakib application. The six units of rotation involving a counterclockwise direction of shaft 10 is a condition which is unique to case shift and does not involve the selection of any characters on the type element.

Positions of all characters are arranged in 24 columns of 4 characters each. It is necessary to only designate six units of clockwise rotation, a home row designation and five units of counterclockwise rotation. Therefore the six units of counterclockwise rotation is always available for case shift functions. As can be seen with the switching of the rack at mid cycle or at the point where cam 20 has translated its maximum distance along shaft 22, during the return of cam 20 the pinion will continue to rotate in a counterclockwise direction inasmuch as the rack has been shifted. This results in a complete 12 units of rotation thus placing the head in a position rotated 180° from its original position. This corresponds to a case shift operation. To shift back to the other case, it being immaterial which case the head is in, a cycle as above described is accomplished.

Figure 3A:
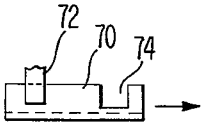
Figure 3B:
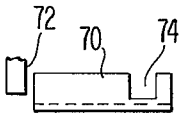
Figure 3C:
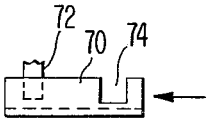
Figure 3D:
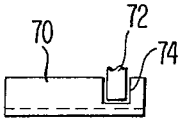

To insure that the rack 14 does not shift inadvertently at some point where it would be either harmful to the mechanism or cause a mis-selection, interlock rail 70 is formed on rack 14. Cooperatively positioned with respect to interlock rail 70 is interlock tab 72. Interlock tab 72 may pass through notch 74 and interlock rail 70 allowing the rack to shift. The portions where interlock rail extends upward from rack 14 can prevent the rack from shifting in one direction or another due to the interference with tab 72. Examples of the positions can be seen in FIG. 3. Interlock rail 74 can be shifted in FIGS. **3*b* and 3*d* inasmuch as tab 72 is not interferred with. However, as can be seen in FIGS 3*a* and 3*c*, an advertent shifting cannot occur inasmuch as tab 72 would physically interfer with interlock rack 74.**

OPERATION

One of the first signals received from a decoding network of a typewriter or printer which incorporates the entire selection mechanism into the carrier, and thus requires signals of some sort to condition the carrier is the rack direction or direction of rotation required for a particular character. This input is binary in nature, either one direction or the other and thus can readily be accomplished by either electronic signals or pneumatic pulses. In the event that an electrical signal is used, the magnet 48 will attract the follower 38, which acts as its armature, into a sealing position thus pulling follower 42 into a zone of engagement with cam 46. At the same time, surface 56 clears radial portion 53 of filter ring 54 allowing the shifting of the follower 38. As this occurs, follower 40 is swung axially away from cam 44 thus preventing engagement of it with the cam 44. Cam 46 and cam 44 are timed with respect to the shaft so that they engage their followers at the same time of the cycle and are displaced only because of displacement of the followers from an identical angular position. As the carrier begins to function in a manner explained in the Shakib specification identified above, shaft 22 and cams 46 and 44 together with filter ring 54 begin to rotate. As filter ring circumference 55 passes under depending portion 56 follower/armature 38 is prevented from further movement under the influence of magnet 48 or spring 52. Thus, the selection as between cams 44 and 46 is assured.

In this case where a signal has been received by electromagnet 48, cam 46 will be the operative cam and causes follower 42 to rotate counterclockwise about the pivot point of rack shift bail 32 in frame member 34. As the follower 42 rotates about its pivot point, shift bail 32 is caused to rotate in a counterclockwise direction, thus forcing rack 14 up and to the left in FIG. 1. This engages rack 16 with pinion 12. Shortly after the completion of the rack shifting cam 20 begins its translation axially with shaft 22 and thus translates rack 14 parallel to the axis of shaft 22. This motion causes rotate element shaft 10 to rotate in a counterclockwise direction. At the end of the translation of cam 20 under the influence of cam grooves and selected follower 26, shaft 10 will stop and printing may occur. As cam 20 falls and returns to its home position, rack 14 and teeth 16 will cause shaft 10 to rotate in a clockwise direction back to its home position. There is no action accomplished to restore rack 14 to any predesignated position or engagement. Inasmuch as the signal to the electromagnet 48 is no longer active and spring 52 does act, follower 38 will be pivoted around its axis of rotation perpendicular to shift bail 32 to cause follower 40 to come into the operative range of cam 44 and follower 42 to be removed from the operative range of cam 46.

On succeeding cycles in the event that a letter is selected which requires the engagement of rack teeth 18 with pinion 12, no signal will be sent to electromagnetic 48 and thus the spring 52 having restored follower 38 and the filter ring 54 preventing shifting of the follower 38 after the cycle is substantially under way, the cam 44 will effect shifting of the rack from rack teeth 16 to rack teeth 18. Thus the rack is shifted only at the beginning of the cycle or at the beginning and at mid-cycle but never at the end of the cycle of operation of the print character.

Thus this rack may be considered a non-return to home rack engagement scheme.

We claim:

1. A printer having a type element mounted for rotation to present different characters to a print position, a pinion connected to said type element for rotation therewith, a drive device comprising a pair of rack members alternatively positionable to engage diametrically opposite portions of said pinion and means for driving an engaged rack member a measured distance wherein the improvement comprises:

a rack selection and positioning mechanism operatively connected to said racks and shiftable to a first rack select position and a second rack select position;

cyclically operable means for providing forces for moving said rack selection mechanism through an operating motion only at the beginning of each print operation;

first and second follower arms alternatively engageable with said cyclically operable means to shift said rack selection and positioning mechanism to said first or second rack selection positions at the beginning of each print cycle and effective to shift said racks to engage a selected one of said racks with said pinion if the other of said racks is engaged.

2. The printer of claim 1 wherein said rack select mechanism further comprises a single pivotable means comprising said follower arms and pivotable in timed relation to said cyclical means.

3. The printer of claim 1 wherein said cyclically operable means comprises a pair of cams.

4. The printer of claim 3 wherein said cams are axially separated by an interference means to permit pivoting of said pivotable means in timed relation with said cyclically operable means and to prevent pivoting of said pivotable means in timed relation to said cyclically operable means, said two timed relations being different portions of the time of said cyclical operations.

5. The printer of claim 4 further comprising a interlock means comprising an interference member moveable with said rack means and a stop member slideably engageable therewith to prevent shifting movement of said rack with respect to said pinion during rack translation.

* * * * *

UNITED STATES PATENT AND TRADEMARK OFFICE

CERTIFICATE OF CORRECTION

PATENT NO. : 3,948,381

DATED : April 6, 1976

INVENTOR(S) : Robert F. McDaniel and John O. Schaefer

It is certified that error appears in the above-identified patent and that said Letters Patent are hereby corrected as shown below:

Column 1 line 32 After "being" insert --able--

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*